US005417319A

United States Patent [19]

Chalberg et al.

[11] Patent Number: 5,417,319

[45] Date of Patent: May 23, 1995

[54] SECURITY CONTAINER FOR DISPLAY OF AUDIO AND VIDEO MEDIA

[75] Inventors: Philip E. Chalberg; Paul N. Kenchel, both of Costa Mesa, Calif.

[73] Assignee: Hydrabaths, Inc., Santa Ana, Calif.

[21] Appl. No.: 216,487

[22] Filed: Mar. 22, 1994

[51] Int. Cl.[6] ..... A45C 13/18; B65D 55/00; B65D 85/672

[52] U.S. Cl. ..... 206/1.5; 70/63; 206/387; 206/405; 206/807; 206/387.11; 292/307 R

[58] Field of Search ..... 206/1.5, 387, 807, 403, 206/405; 70/63, 345; 292/331, 307 R

[56] References Cited

U.S. PATENT DOCUMENTS

| | | | |
|---|---|---|---|
| 1,146,593 | 7/1915 | Palmer | 292/331 |
| 2,028,423 | 1/1936 | Upham | 292/307 R |
| 2,228,326 | 1/1941 | Rau | 292/307 R |
| 3,504,652 | 4/1970 | Norman, Jr. | 206/405 X |
| 4,031,722 | 6/1977 | Michelman et al. | 70/63 |
| 4,106,801 | 8/1978 | De Lima Castro Neto | 292/307 R |
| 4,381,836 | 5/1983 | Rivkin et al. | 206/387 |
| 4,658,955 | 4/1987 | Eichner | 206/1.5 X |
| 4,834,238 | 5/1989 | Hehn et al. | 206/387 |
| 4,865,190 | 9/1989 | Gregerson et al. | 206/1.5 X |
| 5,294,068 | 3/1994 | Baro et al. | 206/405 X |

*Primary Examiner*—Bryon P. Gehman
*Attorney, Agent, or Firm*—Leonard Tachner

[57] ABSTRACT

A substantially transparent or open window injection molded plastic security container having an integral locking mechanism comprising a plurality of locking fingers designed to interface with a plurality of locking bars. The locking mechanism is generally inaccessible to a customer without a special key, which is preferably retained in a location inaccessible to customers but accessible to employees of a retail establishment, such as in a location behind a counter. The locking mechanism is designed to be inserted onto a stable, fixed key and then rotated relative to the key, whereby the key provides preselected movement of the fingers to release them from the locking bars and open the security package to release the contents thereof. In preferred embodiments of the invention disclosed herein, an opaque plastic insert member is also provided, having a plurality of slots for permitting the key to be inserted into the locking mechanism, but reducing the likelihood of an unauthorized person observing the manner in which the fingers are retained by the bars when the security package is locked, thereby reducing the opportunity of unauthorized opening thereof. A preferred embodiment of the invention is implemented with a removable locking mechanism that may be retained by a retail sale or rental establishment even though the container is properly taken by the customer with audio or video media therein.

6 Claims, 7 Drawing Sheets

SECURITY CONTAINER FOR DISPLAY OF AUDIO AND VIDEO MEDIA

BACKGROUND OF THE INVENTION

1. Field of the Invention

The present invention pertains generally to a security box used for protection against the shoplifting of something of value stored therein, and more specifically to an improved lockable, at least partially transparent or windowed container that may be used to securely enclose a recorded media such as a video cassette and wherein the improvement relates to the structure of the locking mechanism therefor.

2. Prior Art

The principal contemporary solution to the problem of shoplifting or pilfering of rentable video cassettes and the like, consists of keeping the actual video cassette away from the public in an area where only employees can access the desired video tape cassette when a customer brings an empty video cassette package to them expressing his or her desire to rent or purchase that particular cassette. While such a technique is effective in preventing the shoplifting and pilfering of video cassettes, it is costly in terms of additional labor required by employees to access the actual video tape. It is also inefficient from an overhead standpoint because it requires additional storage space for the cassettes which must be stored apart from their containers, thereby effectively doubling the space requirements for a library of rentable video cassettes. The problem of shoplifting and pilfering also extends to audio compact discs, the packaging for which is undergoing a change in the industry due to ecological considerations. More specifically, the elongated, large paper containers that were effective in reducing shoplifting of such compact discs are becoming obsolete in favor of smaller packages which are much more easily removed illegally from a retail facility. Consequently, there is a need to secure small and relatively valuable audio/visual articles in removable security packages to inhibit shoplifting. There have been a number of prior art patents illustrating the prior attempts to produce such a package but unfortunately all of them have proved unsatisfactory for one reason or another. The predominant reason is related to the cost and complexity of elaborate locking devices designed to prevent the unauthorized removal of the contents of such security packages at the shelf site by a customer who intends to shoplift or otherwise tamper with the contents thereof. The following patents, all of which constitute prior art to the present invention, are examples of such attempts.

U.S. Pat. Des. No. 302,945 Mortensen et al U.S. Pat. Nos. 4,285,429 MacTavish 4,589,549 Hehn 4,634,004 Mortensen 4,718,547 MacTavish 4,753,347 Bellante et al 4,759,442 Gregerson et al 4,805,769 Soltis et al 4,819,797 Holmgren 4,834,238 Hehn et al 4,865,190 Gregerson et al 4,871,065 Hehn et al 4,962,854 Ricci 4,966,283 Sykes et al 4,987,999 Hehn 4,988,000 Weisburn et al 5,039,982 Bruhwiler.

U.S. Pat. No. 4,834,238 to Hehn et al is directed to a reusable one-piece molded plastic package for use as a security and display package for cassettes. The package is a one-piece molded plastic unit having a hanger or handle, 4 in FIG. 1, and of sufficient size to deter unauthorized removal from retail outlet. Media housing 3, with cassette storage compartment 10, is integrally connected to a hanger 4 by sidewall sections 7 (FIG. 1).

Cutouts 14 and 16 enable contents of compartment 10 to be examined for title, artist, etc. imprinted on cassette stored therein. With cassette in place within compartment 10, slide plate 20 with living hinges 24 and 25 is moved into position (FIGS. 11, 12 and 13), and is engaged with lock housing 18 for locking cassette into compartment 10. Release of cassette is possible by sales clerk using a key shown in FIGS. 23 and 25. Utilization of the device described may be applied to other media formats, such as CD's by modifications shown in FIGS. 26 and 31. The locking device is best seen and understood by referring to FIGS. 21 and 22.

U.S. Pat. No. 4,819,797 to Holmgren is directed to a seal for a box enclosing a compact disc or tape cassette including video cassettes and the like. The box comprises two rectangular box halves which are hingedly connected to one another by living hinges. The system provides for a blocking element to be applied to the box, thus preventing the box from being opened without a special tool for unlocking the latch mechanism. The box described is made of a plastic material with at least a portion thereof being transparent, such that informational text on the disc or cassette within the box may be exposed to the outside surface for reference thereto. Referring to FIGS. 1, 2 and 3, the seal of the invention in the form of a U-shaped blocking box, is applied to the closed box by positioning the flat web 14 against the outside surface of box 10, while flap 17 of the bow is inserted into one of the two opposite edge apertures 13 in box half 11. The sockets 18 provided on the other end are inserted in the opposite edge aperture 13 provided for this purpose. Applied in this manner, the blocking bow keeps the two box halves together and prevents opening without the use of a special tool utilized by the cashier upon selling of the merchandise. An alternative latch mechanism is shown in FIGS. 4–8. Again, this device can be unlocked by utilizing a special tool such as by inserting two pins 26 into openings 25 and pressing the pins against the limbs of element 20 so that the projection 21 is disengaged. One example of an unlocking apparatus is shown in FIGS. 14–18 when used with reference to FIGS. 4–6. Application of this device to video cassettes requires modifications which are shown in FIGS. 19–22. The latch mechanism used in conjunction with the video tape application of this invention may be seen in FIGS. 23 and 24.

U.S. Pat. No. 4,589,549 to Hehn is directed to a molded plastic package for displaying and securing audio cassettes and discs. One form of the package shown in FIGS. 3–6 is a one-piece molded plastic unit of high impact polystyrene. Referring to FIG. 3, one sees a locking device 35 mounted on cassette housing 5 for locking cassette 3 into storage compartment 11 until removal is desired by a sales clerk using a manually actuated key. This key is shown as numeral 37 in FIG. 11. Latching of the device is made possible by projections 71 and 72 engaging locking nubs 60 mounted on locking levers 40 and 41, as seen in FIG. 14. When slide plate 38 is in this forward locking position, cassette 3 is securely retained within its compartment and unauthorized removal is prevented. Locking nubs 60 may be disengaged from projections 71 and 72 by utilizing key 37.

U.S. Pat. No. 4,285,429 to MacTavish describes another security container for a tape cassette. As seen in FIG. 1, the security device 10 includes a rectangularly shaped container 11 for receiving a tape cassette 12. The cassette 12 is retained within the housing 11 by a locking mechanism which includes a plug member 13 and a specially constructed key member 14. As seen in FIG. 4, the surfaces of the cassette may be viewed through the entry opening 22 and other display openings 50, 51, and 52. The device described is another example of a reusable display and security container for video tapes, cassette tapes, and CD's.

U.S. Pat. No. 5,039,982 to Bruhwiler is directed to a casing to be used as a security device for tape recording cassette containers. Referring to FIGS. 1 and 2, the casing 11 is made of a transparent plastic and has a hollow space 2 for receiving a cassette therein. The casing includes at its inner side a commonly known element 25, which may trigger an alarm. Locking of the cassette into the casing is made possible by locking bodies 10 mounted on base disc 11 which holds the cover 16 of the cassette container by means of end section 12 (see FIGS. 1 and 2). In order to separate the tape recording cassette container from the casing 1, the interconnection between the locking body 10 and the base disc 11 which is shown as a weakened zone 13, must be ruptured using a special tool device.

Each of the aforementioned prior art patents discloses a security container which is too complex, too costly, not sufficiently secure or otherwise unsatisfactory for the intended purpose.

SUMMARY OF THE INVENTION

The aforementioned deficiencies of the prior art, including the aforementioned disadvantages of the plurality of prior art packages designed to lock video or audio recording media in a container, are overcome in the present invention. More specifically, the present invention comprises a substantially transparent or open window injection molded plastic security container having an integral or removable locking mechanism comprising a plurality of locking fingers designed to interface with a plurality of locking bars. The locking mechanism is generally inaccessible to a customer without a special key, which is preferably retained in a location inaccessible to customers but accessible to employees of a retail establishment, such as in a location behind a counter. The locking mechanism is designed to be inserted onto a stable, fixed key and then rotated relative to the key, whereby the key provides preselected movement of the fingers to release them from the locking bars and open the security package to release the contents thereof. In preferred embodiments of the invention disclosed herein, an opaque plastic insert member is also provided, having a plurality of slots for permitting the key to be inserted into the locking mechanism, but reducing the likelihood of an unauthorized person observing the manner in which the fingers are retained by the bars when the security package is locked, thereby reducing the opportunity of unauthorized opening thereof. A preferred embodiment of the invention is configured to permit removal of the locking mechanism from the container.

While it is known in the prior art to provide a security locking device which may be unlocked by a key to open a storage container for video tapes and the like, the relatively low cost, the simplicity of design, the high reliability and high level of security provided by the present invention in a novel and unobvious locking configuration, constitutes a significant and patentable improvement thereover, the details of which will be more fully understood hereinafter.

OBJECTS OF THE INVENTION

It is therefore a principal object of the present invention to provide a substantially transparent or open window injection molded plastic security container having an integral or removable locking mechanism designed to securely enclose and lock a contained video or audio recording device such as a video cassette tape or compact disc.

It is another object of the present invention to provide a security container for housing recording media and having a locking mechanism which is generally inaccessible to a customer without a special key which is preferably retained in a location inaccessible to a customer but accessible to employees of a retail establishment.

It is still an additional object of the present invention to provide an improved locking container for recorded media such as for video tapes and the like and having a locking mechanism designed to be inserted onto a stable fixed key and then rotated relative to the key, whereby the key provides a preselected movement of surfaces of locking fingers to open the security container to release the contents thereof.

It is still an additional object of the present invention to provide an improved security locking device which may be unlocked by a key to open a storage container for video tapes and the like, the locking device having a relatively low cost and simple design and yet having a high reliability and high level of security.

It is still an additional object of the present invention to provide a security container having an integral locking device wherein the security container and the locking device may be implemented without separately moving parts and thus fabricated by inexpensive injection molded plastic processing, thereby minimizing the cost of the labor associated with the manufacture thereof.

It is still an additional object hereof to provide a security container having a locking device which may, when unlocked, be entirely removed from the container.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF PREFERRED EMBODIMENTS

Figure 1:
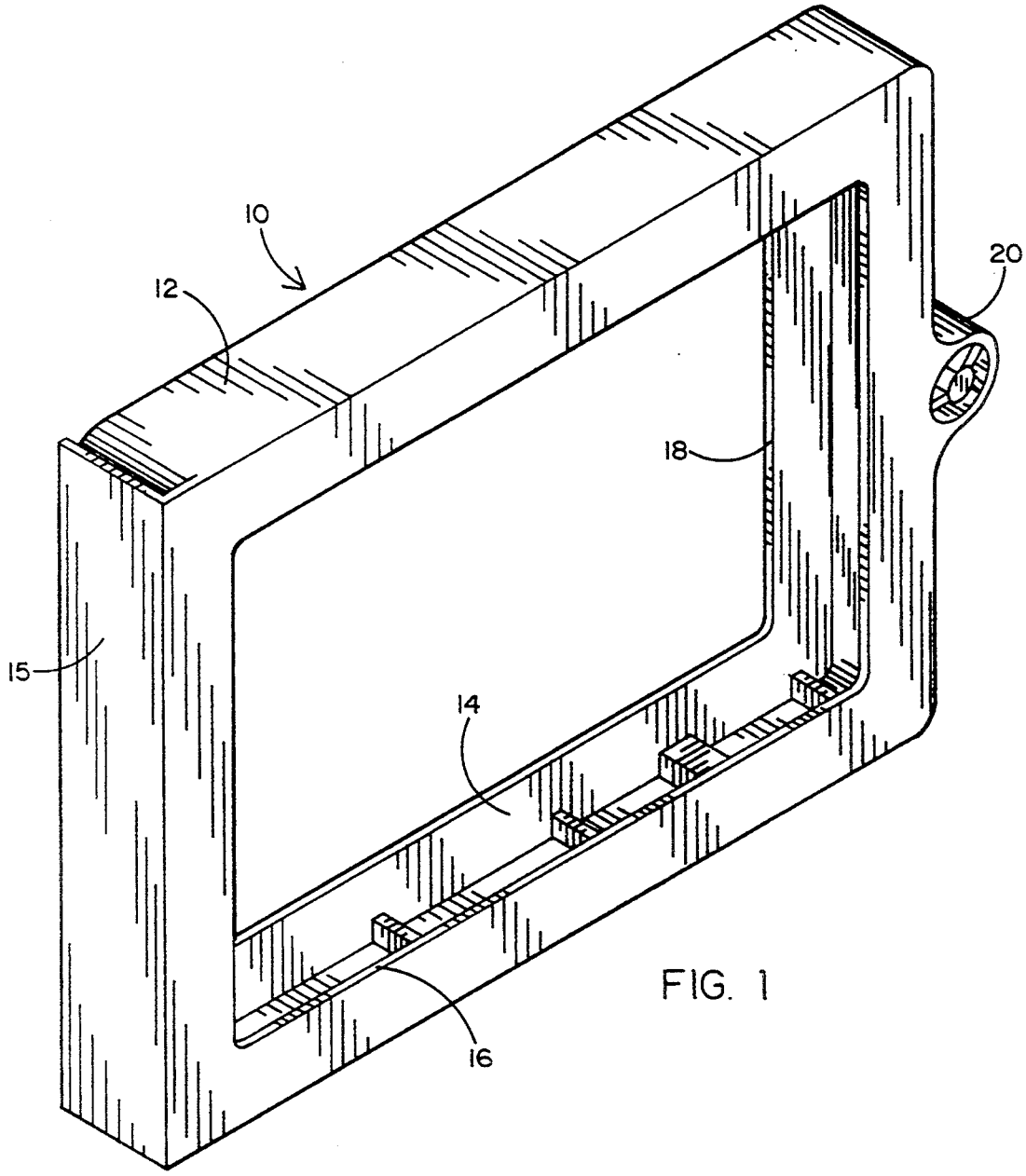
FIG. 1 is an isometric view of a fully assembled configuration of a first embodiment of the present invention.
Figure 2:
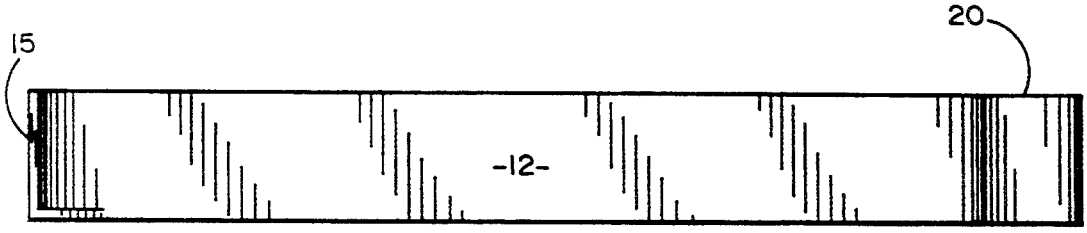
FIG. 2 is a side view thereof.

Referring now to the accompanying figures and initially FIGS. 1–4 thereof, it will be seen that a first embodiment of the present invention comprises a security container 10, having a top member 12 and a bottom member 14, each joined by living hinges 17 and 19 respectively, to a back member 15. It will be seen further that each of these rectangular-shaped top and bottom members 12 and 14, respectively provides a window cutout also of rectangular shape, whereby top member 12 provides a window 16 and bottom member 14 provides a window 18.

It will also be seen in FIGS. 1–4 that the security container 10 of the present invention comprises a locking device 20, which, in turn, comprises a top locking member 22 and a bottom locking member 24. The top locking member 22 is integrally formed with the top member 12 and the bottom locking member 24 is integrally formed with the bottom member 14. In fact, all of the principal parts of the security container 10 are integrally formed as a unitary member, preferably fabricated by injection molding using a translucent or transparent plastic such as polypropylene of sufficient dimensions to encase a recording media to be protected thereby, such as for example, a VHS video cassette tape. The container is preferably made of a plastic of which the thickness is sufficient, when taking into account the strength of the material, to prevent unauthorized removal of the security container from the recording media contained therein. The only part of the present invention which is not an integral component thereof is a plug insert 25 which is used to increase the security of the locking relationship between the components of the locking device 20 as will be described hereinafter in more detail.

Figure 3:
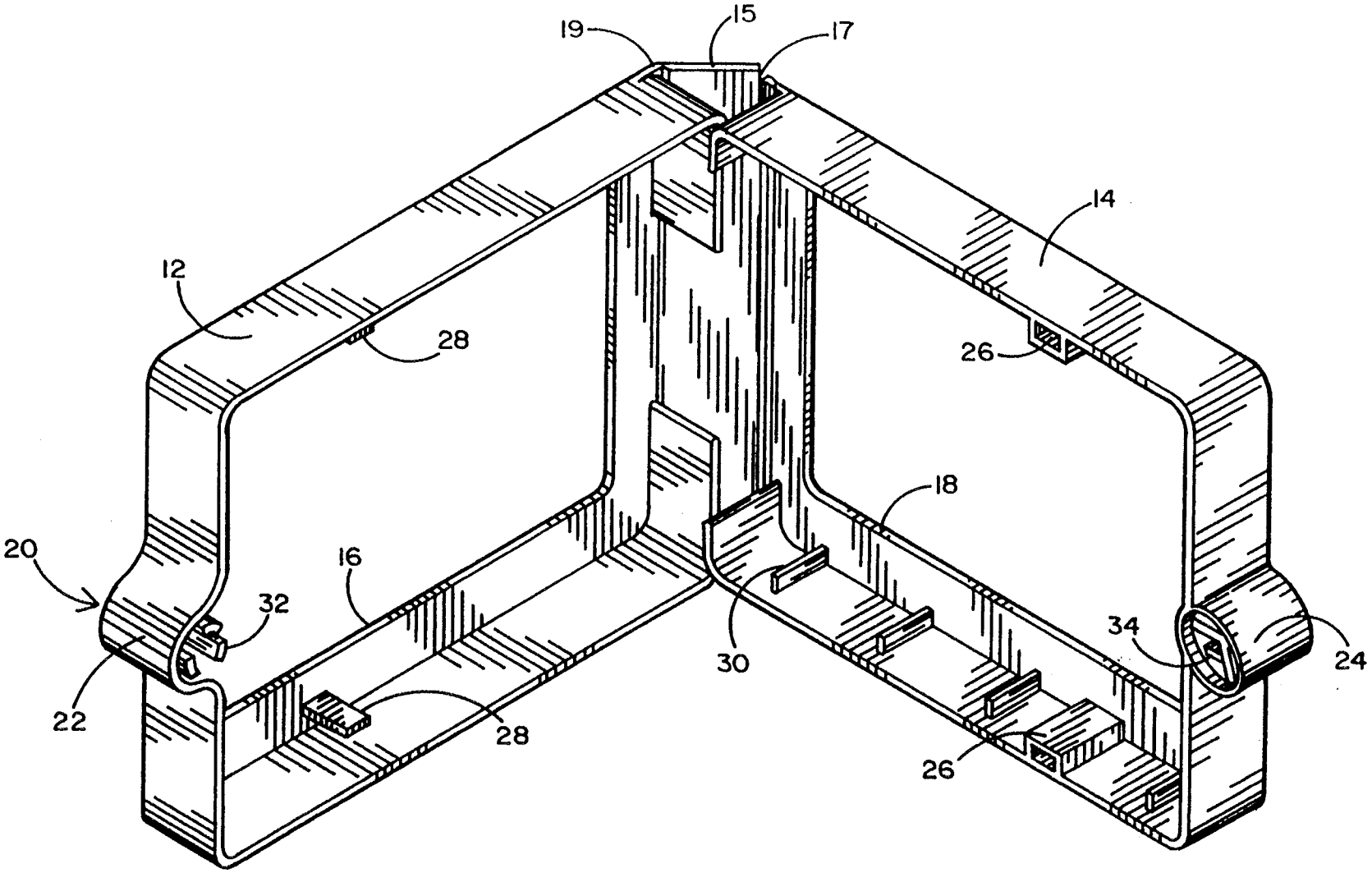
FIG. 3 is a isometric view of the first embodiment of the present invention shown in its open configuration, ready to receive a video tape therein.
Figure 4:
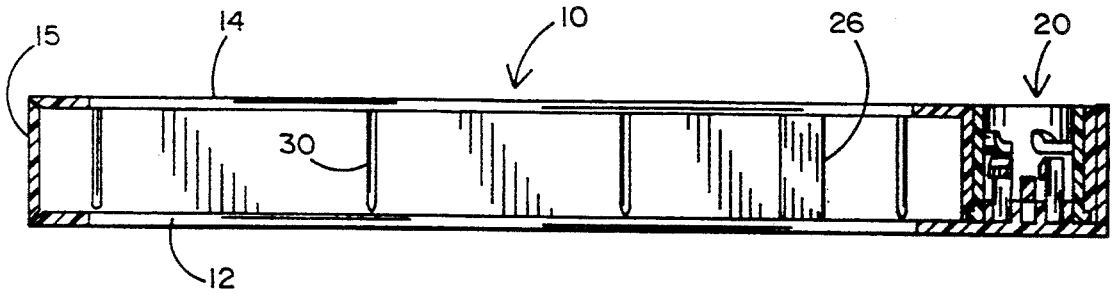
FIG. 4 is a view of the invention similar to that of FIG. 2, but shown in cross-section.
Figure 5:
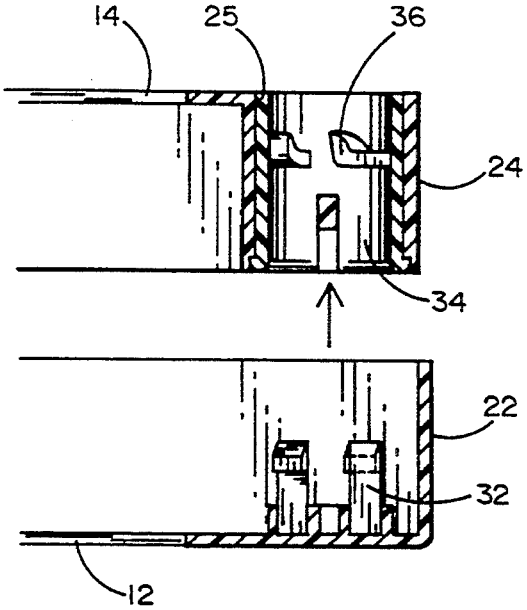
FIG. 5 is an enlarged view of the locking mechanism of the present invention shown in its partially open configuration.
Figure 6:
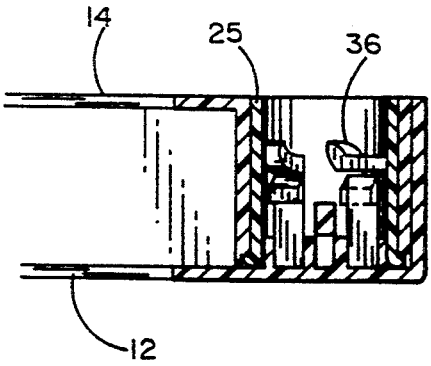
FIG. 6 is a view similar to that of FIG. 5, but showing the locking mechanism in its locked configuration.

The alignment, strength and interconnection security of the top and bottom members 12 and 14, respectively may in addition be improved in the present invention by the use of a plurality of receptacles 26 and tabs 28, seen best in FIG. 3, as well as a plurality of lateral ribs 30, also seen best in FIG. 3. As seen further in FIG. 3, the top locking member 22 comprises a plurality of locking fingers 32 and the bottom locking member 24 comprises a plurality of locking bars 34. Furthermore, as seen in FIGS. 5 and 6, the top locking member 22 and the bottom locking member 24 are aligned, when the top member 12 and the bottom member 14 are rotated into a virtually interconnected configuration as shown in FIG. 5, and are fully interconnected in locking engagement in the configuration illustrated in FIG. 6.

Figure 8:
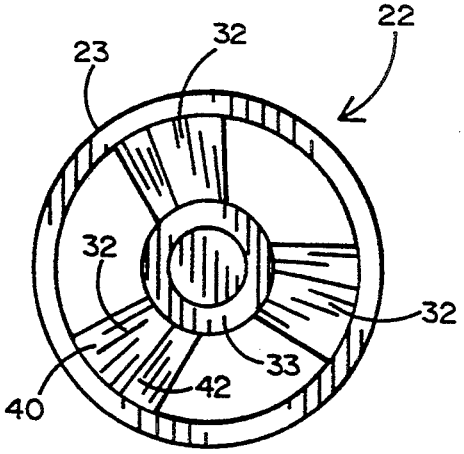
FIG. 8 is a plan view of the top locking member of the present invention.
Figure 10:
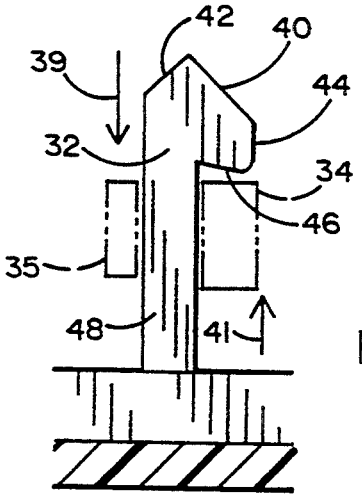
FIG. 10 is an enlarged side view of a locking finger employed in the present invention.

As seen in FIG. 10 each of the fingers 32 comprises a pair of chamferred faces 40 and 42 and a release face 44, the latter forming a shoulder 46 relative to a leg 48. As seen further in FIG. 10, when the locking finger 32 fully engages the locking bar 34 in the configuration shown in FIG. 6, the locking bar 34 is positioned beneath the shoulder 46 so that the locking bar prevents the release of the finger in the direction of arrowhead 39. As seen further in FIG. 10, a retainer 35 is positioned behind the leg 48 of the finger 32, preventing lateral movement of the finger, relative to the locking bar so that separation therebetween cannot occur inadvertently. The chamferred faces 40 and 42 of the locking finger 32 permit easy penetration of the locking finger between the locking bar 34 and a retainer 35 in the direction of arrowhead 41. As seen in FIG. 8, there are three such locking fingers 32 spaced symmetrically about the top locking member 22 and secured between an outer ring-shaped wall 23 and an inner circular hub 33. Similarly, the bottom locking member 24 comprises three locking bars 34, symmetrically positioned within an outer ring shaped wall 27 and extending inwardly to a centrally positioned triangular-shaped hub 29, where each of the three locking bars 34 merge into an integral relationship at the hub. Thus, the locking bars 34 are fixed and relatively immovable to provide a secure barrier against unauthorized withdrawal of the locking fingers 32 because of the interaction of the shoulder 46 thereof and a locking bar 34.

Figure 9:
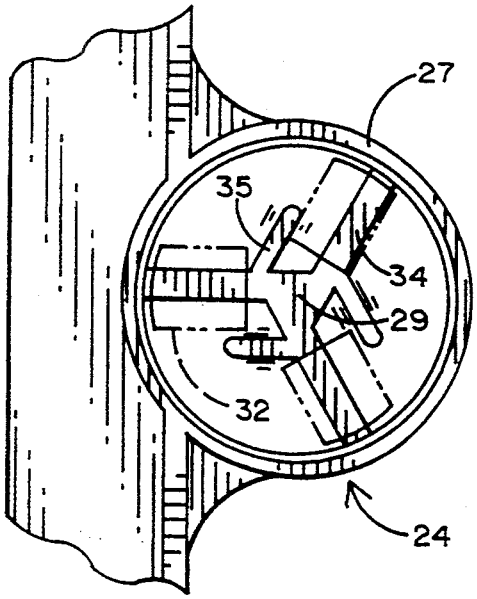
FIG. 9 is a plan view of the bottom locking member of the present invention.

As seen further in FIG. 9, there are also three retainers 35, a respective one being positioned in spaced, parallel relation to each of the three locking bars 34 providing a gap therebetween for receiving a locking finger 32 from the top locking member 22. However, the retainers 35, unlike the locking bars 34, do not extend outwardly to the ring shaped wall 27, but, in fact, terminate at a position spaced from the wall 27, thereby leaving each retainer with the freedom to rotate slightly to increase the gap between it and its corresponding locking bar 34 upon operation of a key to unlock the locking device 20 in a manner to be described hereinafter in more detail in conjunction with FIGS. 11, 12 and 13.

Figure 7:
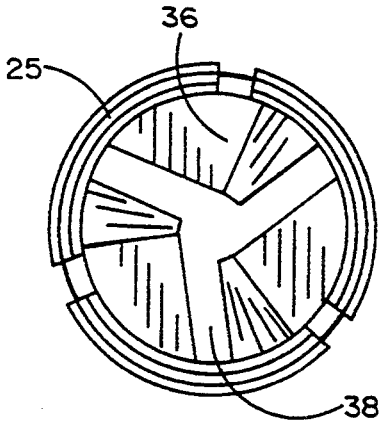
FIG. 7 is a top or axial view of a plug insert used in the locking mechanism.

The use of three locking fingers and corresponding locking bars in the locking device 20 of the present invention significantly enhances the security of the inter-relationship therebetween when the security container 10 is closed and locked. However, for purposed of further increasing the security of such a locking configuration, an optional plug insert 25 shown in FIG. 7 may also be provided. More specifically, the plug insert 25 seen in FIGS. 5, 6 and 7, is a cylindrical device of a generally hollow configuration, but having three generally triangular shaped platforms 36, extending from the inside wall thereof, towards the center and spaced from one another to form three elongated slots 38 symmetrically spaced around the interior of the plug insert 25. The plug insert 25 is preferably made of an opaque, heavy-duty plastic material (such as polycarbonate) and is generally designed to serve two purposes. One such purpose is to obscure the relationship between the locking fingers 32 and the locking bars 34, thereby making it more difficult for unauthorized personnel to understand the locking engagement therebetween which thus inherently reduces the likelihood of an unauthorized opening thereof. Furthermore, the second purpose of the plug insert 25 is to reduce the access to the locking fingers and locking bars so that only a specially designed key, designed to fit through the slots 38, can be used to gain access to the locking fingers in a manner to be described hereinafter for authorized unlocking of the locking device 20 of the present invention.

Figure 11:
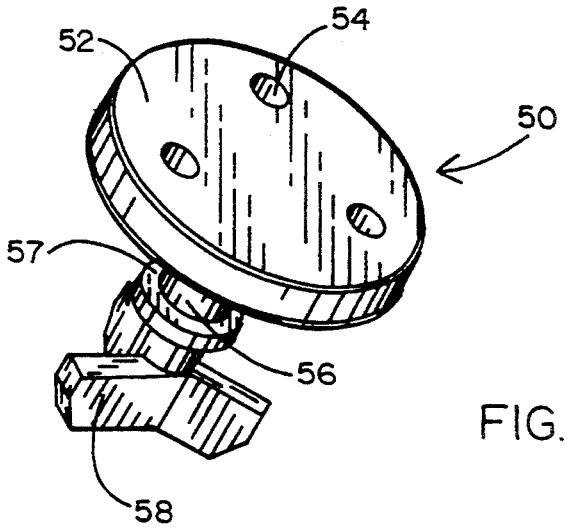
FIG. 11 is a three-dimensional view of a key used in the preferred embodiment of the invention.
Figure 12:
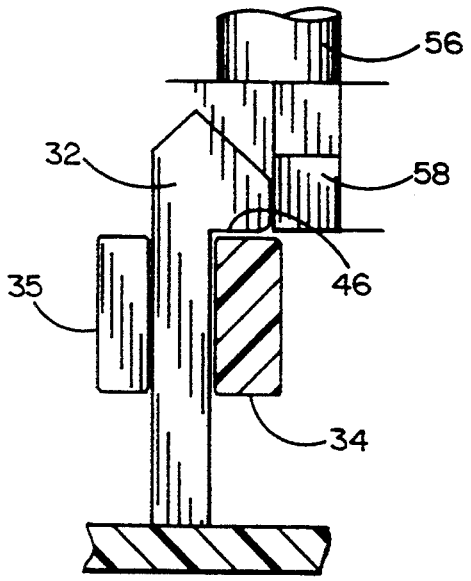
FIGS. 12 and 13 are simplified illustrations showing the interaction of the key and the locking device, before and after unlocking that device.
Figure 13:
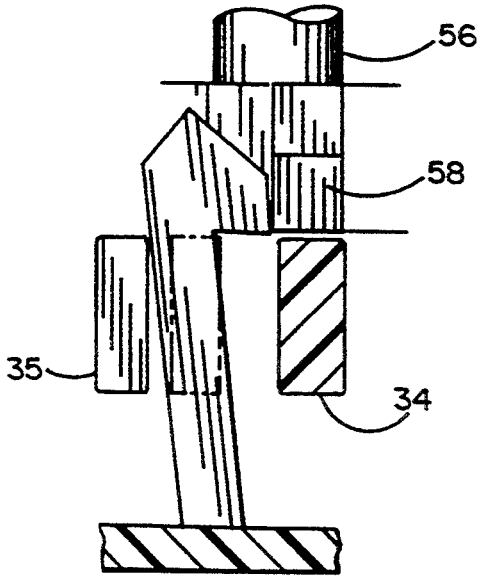

Reference will now be made to FIGS. 11 through 13 for a description of the key and the manner of operation of the key for unlocking the locking device of the present invention. More specifically, as shown in FIG. 11, a key 50 comprises a base 52 having a plurality of screw holes 54 which are provided for securing the base 52 and thus the key 50 to a stable surface such as the underlying surface of a countertop and the like. Key 50 also provides an elongated cylindrical shaft 56 extending perpendicularly from the base 52 which terminates in a plurality of radially disposed pushing surfaces 58. A location ring 57 is provided around the radial surface of the shaft between the pushing surfaces and the base.

It will be observed that the preferred embodiment of the key 50 shown in FIG. 11 has three such radially disposed pushing surfaces 58, configured to precisely align with the slots 38 of the plug insert 25 shown in FIG. 7 by way of example. Thus, in a preferred form of operation of the present invention when using the key 50 to unlock the security container 10, the security container is maneuvered relative to the key until the locking device 20 is adjacent the key 50 and the pushing surfaces 58 are aligned with the slots 38 of plug insert 25. At this point, the security container is translated relative to the key until the pushing surfaces 58 enter and pass through the slots 38 of the plug insert 25 and until the location ring 57 contacts the shoulders 36 of the plug insert (see FIG. 7). At this point, the key 50 is fully inserted into the locking device 20 of the security container 10, and each of the pushing surfaces 58 is positioned relative to a locking finger 32 in the manner illustrated in FIG. 12. More specifically, each such pushing surface 58 is positioned immediately adjacent a release face 44 of a corresponding locking finger 32 so that rotation of the security container relative to the key, will rotate the pushing surfaces from the position shown in FIG. 12 to the position shown in FIG. 13. As seen in FIG. 13 rotation of the security container relative to the key, results in the pushing surfaces 58 pushing the locking fingers 32 away from the locking bars 34 and deflecting the retainers 35 by bending the leg 48 of the locking finger. This bending is sufficient to completely displace the shoulder 46 of the locking finger 32 from the locking bar 34 so that the finger can then be laterally displaced in the direction of the arrowhead shown in FIG. 13, thereby unlocking the locking device 20 and allowing the security container 10 to be opened. Of course, it will be understood that the pushing action illustrated in FIGS. 12 and 13 is occurring simultaneously on all three of the locking fingers 32 to thereby disengage all three locking fingers from the corresponding locking bars simultaneously thus permitting the security container 10 to be opened. After the security container 10 is opened, the container is removed from the key 50 by rotating the container back to the position in which the pushing surfaces 58 are again aligned with the slots 38, allowing withdrawal of the container from the key. It will be understood that upon withdrawal of the container from the key, the relatively flexible polypropylene locking fingers resume their previous unbent configuration and simultaneously the relatively flexible polypropylene retainers 35 also resume their position wherein they are parallel to the locking bars 34. Thus, the top locking member 22 and the bottom locking member 24 are automatically reconfigured for relocking the security container upon closure of the top and bottom members 12 and 14, respectively such as when another video tape is positioned therein.

Figure 14:
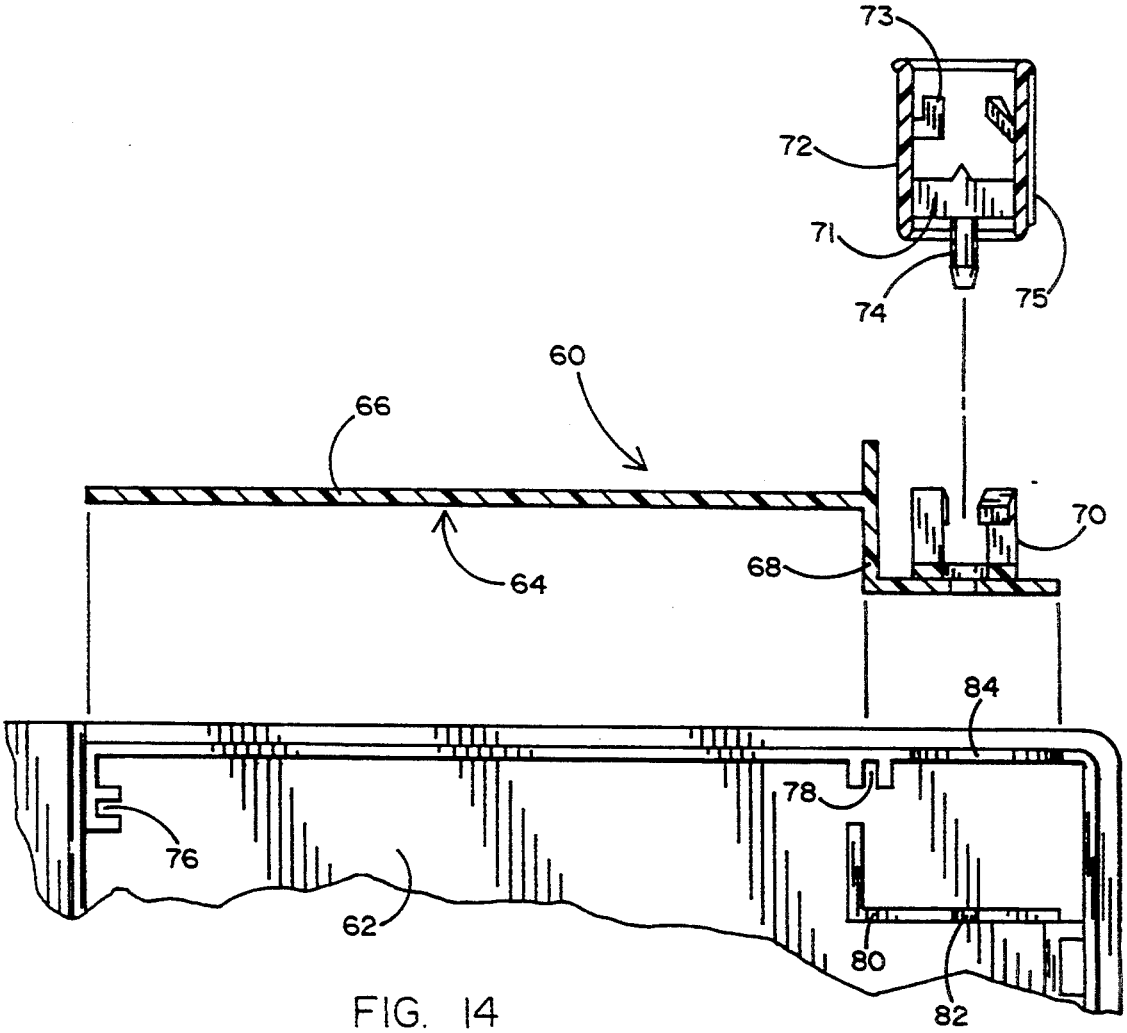
FIG. 14 is an exploded view of a second embodiment of the invention.
Figure 15:
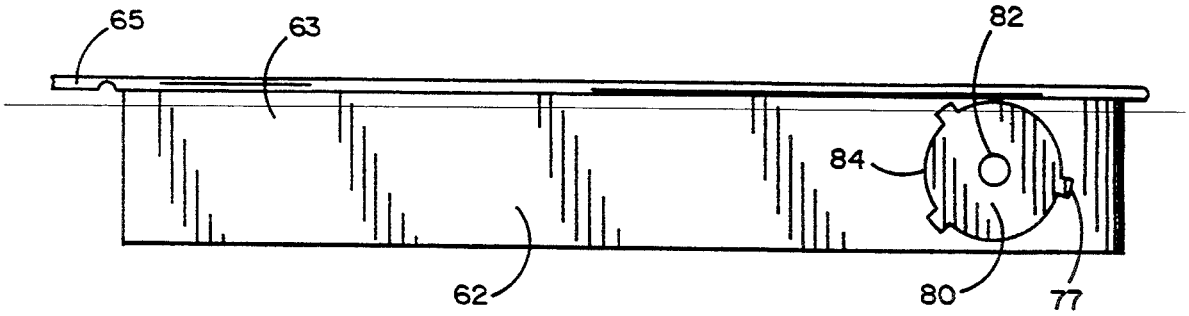
FIG. 15 is a top view of the second embodiment.
Figure 16:
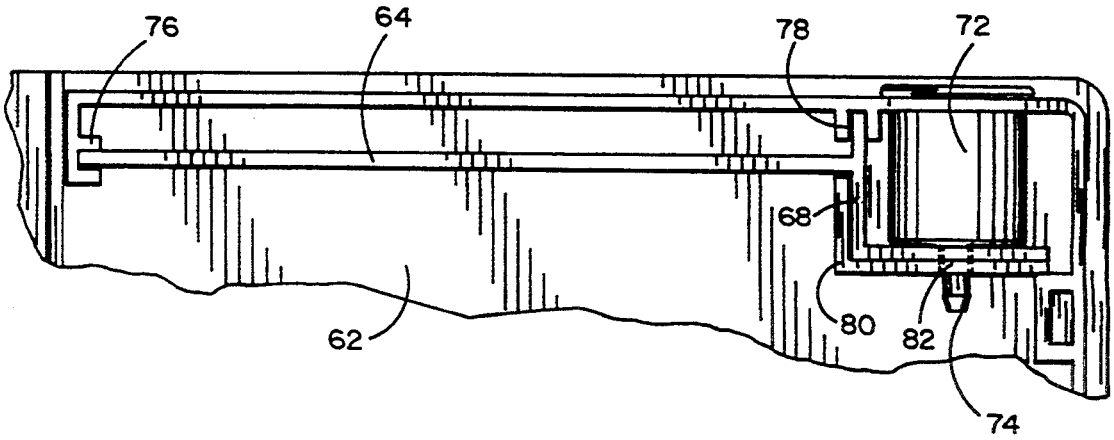
FIG. 16 is a front view of the second embodiment with the container open to reveal the locking mechanism.

A second embodiment of the present invention is shown in FIGS. 14, 15 and 16. This second embodiment security chamber 60 employs the same locking mechanism of the first embodiment, but it is configured to allow the locking device to be entirely removed from the container. Such a removal feature may be advantageous where, for example, it is desired to permit a customer to retain the container with the media inside, but without disclosing the configuration of the locking device.

Referring to FIGS. 14 to 16, it will be seen that security container 60 comprises a preferrably injection-molded plastic container 62 having top member 63 and bottom member 65 and configured to receive a removable member 64, the latter comprising an elongated portion 66 and an integral L-shaped portion 68. As shown best in FIG. 14, the locking fingers 70 of this embodiment are integrally affixed to the L-shaped portion 68. A locking device cylindrical housing 72 provides platforms 73 and locking bars 71, the latter which, in combination with locking fingers 70, provide the same locking function as described above in relation to the first embodiment of FIGS. 1–10. However, the housing 72 also provides a probe 74 and three positioning keys 75 (for alignment with key slots 77 shown in FIG. 15) to assure proper axial and positional alignment of fingers 70 and locking bars 71 when the locking device is fully assembled as shown in FIG. 16.

In order to assemble security container 60, the removable member 64 is first positioned in container 62 by inserting elongation portion 66 into a retention slot 76 and by concurrently inserting L-shaped portion 68 in a retention slot 78 while resting the L-shaped member in a support bracket 80. Slots 76 and 78 and support bracket 80 are provided in container 62 as integral members thereof formed during injection molding of the container. A hole 82 receives the probe 74 and a circular aperture 84 receives the housing 72. Aperture 84 provides key slots 77 to align the housing 72 therein. Of course, it will be understood that bottom member 65 of container 62 provides a mating aperture (not shown) to lock members 63 and 65 when fingers 70 and locking bars 71 are engaged. As shown in FIG. 14, when the locking device is unlocked, housing 72 as well as member 64 may be removed from container 62, leaving only slots 76 and 78 and bracket 80 within the unlocked container. The container may then be used to store a video cassette or the like in a conventional fashion without exposing the locking device to any tampering or unauthorized disclosure.

It will now be understood that what has been disclosed herein comprises a security container for locking video or audio recording media so that they may be more safely displayed in a location accessible to the general public while reducing the likelihood of shoplifting and the like. It will also be understood that the present invention incorporates a unique, simple but nevertheless highly reliable and secure locking device comprising a plurality of fingers designed to interface with a plurality of locking bars in a configuration which is generally inaccessible to a customer without a special key which is preferably retained in a location inaccessible to customers, but accessible to employees of a retail establishment such as in a location behind a counter.

The locking mechanism of the present invention is designed to be inserted onto a stable fixed key and then rotated relative to the key, whereby the key provides preselected movement of the fingers to release them from the locking bars and thus open the security package to release the contents thereof. In a preferred embodiment of the invention disclosed herein, an opaque plastic insert member is also provided and having a plurality of slots for permitting the key to be inserted into the locking mechanism, but reducing the likelihood of an unauthorized person observing the manner in which the fingers are retained by the bars when the security package is locked, thereby reducing the opportunity of unauthorized opening thereof. Both integral and removable embodiments of the locking device have been disclosed.

Those having skill in the art to which the present invention pertains, will as a result of the applicant's teaching herein now perceive various modifications and additions which may be made to the invention. By way of example, the precise shape and dimensions of the components of the locking mechanism disclosed herein may be readily altered, such as for accommodating different size containers for securely housing articles of other shapes, the value and size of which also create concerns about shoplifting. For example, the present invention in a modified configuration may be used to protect small cameras, calculators, and other electronic paraphernalia, thus permitting customers to handle and examine such devices while minimizing the opportunity for shoplifting by concealing such devices in the clothing, such as in coat pockets and like. Consequently, it will be understood that all such modifications and additions which may be made to the present invention are deemed to be within the scope of the protection afforded hereby in accordance with the appended claims and their equivalents.

We claim:

1. An improved security container for lockably enclosing an article of value, the container having top and bottom members and a locking device which locks the top and bottom members to each other when the container is closed; the improvement comprising:

a plurality of locking fingers;

a plurality of locking bars;

respective ones of said locking fingers and said locking bars being substantially aligned relative to each other upon closing said container;

each said locking finger having a shoulder for overhanging blocking relation with a respective one of said locking bars upon locking therewith for preventing the opening of said container; and a plurality of bendable retention members, a respective one of said retention members being adjacent to a respective locking finger opposite the shoulder thereof and being in spaced parallel relation to each locking bar for maintaining said locking when each said retention member is unbent and for releasing said locking when each said retention member is bent;

the retention members further comprising three of said locking fingers, three of said locking bars and three of said retention members;

wherein said three locking fingers are arranged symmetrically around a hub.

2. The improved container recited in claim 1 further comprising a key having a shaft and at least three symmetrically spaced pushing surfaces extending radially from said shaft for simultaneously pushing respective shoulders of said locking fingers away from respective locking bars while bending said retention members for releasing said locking engagement.

3. The improved container recited in claim 2 further comprising a plug insert positioned adjacent said locking bars and having at least three platforms spaced symmetrically to form three slots for receiving said pushing surfaces of said key and for preventing other objects from reaching said locking fingers whereby to prevent unauthorized opening of said container.

4. The improved container recited in claim 3 wherein said platforms of said plug insert are opaque to obscure visual access to said locking fingers.

5. An improved security container for lockably enclosing an article of value, the container having top and bottom members and a locking device which locks the top and bottom members to each other when the container is closed; the improvement comprising:

a plurality of locking fingers;

a plurality of locking bars;

respective ones of said locking fingers and said locking bars being substantially aligned relative to each other upon closing said container;

each said locking finger having a shoulder for overhanging blocking relation with a respective one of said locking bars upon locking therewith for preventing the opening of said container; and a plurality of bendable retention members, a respective one of said retention members being adjacent to a respective locking finger opposite the shoulder thereof and being in spaced parallel relation to each locking bar for maintaining said locking when each said retention member is unbent and for releasing said locking when each said retention member is bent;

the retention members further comprising three of said locking fingers, three of said locking bars and three of said retention members;

wherein said three locking bars are arranged symmetrically around a hub.

6. An improved security container for lockably enclosing an article of value, the container having top and bottom members and a locking device which locks the top and bottom members to each other when the container is closed; the improvement comprising:

a plurality of locking fingers;

a plurality of locking bars;

respective one of said locking fingers and said locking bars being substantially aligned relative to each other upon closing said container;

each said locking finger having a shoulder for overhanging blocking relation with a respective one of said locking bars upon locking therewith for preventing the opening of said container; and a plurality of bendable retention members, a respective one of said retention members being adjacent to a respective locking finger opposite the shoulder thereof and being in spaced parallel relation to each locking bar for maintaining said locking when each said retention member is unbent and for releasing said locking when each said retention member is bent;

the retention members further comprising three of said locking fingers, three of said locking bars and three of said retention members;

wherein said three retention members are arranged symmetrically around a hub.

* * * * *